United States Patent [19]

Myers et al.

[11] Patent Number: 4,673,468

[45] Date of Patent: Jun. 16, 1987

[54] COMMERCIAL NICKEL PHOSPHORUS ELECTROPLATING

[75] Inventors: Nancy E. Myers, Kettering; Rodger L. Gamblin, Dayton; David J. Sugg, Kettering, all of Ohio

[73] Assignee: Burlington Industries, Inc., Greensboro, N.C.

[21] Appl. No.: 732,277

[22] Filed: May 9, 1985

[51] Int. Cl.[4] ..... C25D 3/58

[52] U.S. Cl. ..... 204/24; 204/27; 204/28; 204/33; 204/44.5; 204/44.7; 204/32.1; 204/38.4; 427/301; 427/304; 427/305

[58] Field of Search ..... 204/44.5, 44.7, 22, 204/27, 24, 28, 33, 38.4, 30, 32.1, DIG. 13; 106/1.27; 427/301, 304, 305

[56] References Cited

U.S. PATENT DOCUMENTS

| | | | |
|---|---|---|---|
| 2,643,221 | 6/1953 | Brenner et al. | 204/43 |
| 2,739,107 | 3/1956 | Ricks | 204/37 |
| 3,817,774 | 6/1974 | Kuznik | 204/30 |
| 3,856,653 | 12/1974 | Rogers et al. | 204/286 |
| 3,956,097 | 5/1976 | DeNora et al. | 204/252 |
| 4,022,679 | 5/1977 | Koziol et al. | 204/286 |
| 4,042,382 | 8/1977 | Feldstein | 75/170 |
| 4,077,864 | 3/1978 | Vanderveer et al. | 204/285 |
| 4,160,049 | 7/1979 | Narcus | 427/277 |
| 4,380,493 | 4/1983 | Wortley et al. | 204/105 M |
| 4,528,070 | 7/1985 | Gamblin | 204/11 |
| 4,529,668 | 7/1985 | Croopnick et al. | 428/665 |

FOREIGN PATENT DOCUMENTS

| | | | |
|---|---|---|---|
| 55-31181 | 3/1980 | Japan | 204/22 |
| 50190 | 3/1984 | Japan | 204/44.7 |

OTHER PUBLICATIONS

"Processes for Fabrication of 7000 Series Al Alloys", by Sulinski et al., U.S. Pat. No. 3,847,181, 1974, Abstract and Cl. 1.

"Marine Cleat and Rope Guide", by Brown, U.S. Pat. No. 3,507,243, 1970 Claim.

"Unitized In Line Electron Gun—by Bozzay et al., U.S. Pat. No. 4,096,408, 1978, Abstract & Cl. 1.

"Electroformed Bulk Ni-P Metallic Glass", Mayer et al., Plating . . . Nov. 1985, pp. 76–80.

Brenner, "Electrodeposition of Alloys, Principles and Practice"; 1963, Academic Press, New York and London, pp. 465 and 466.

Hipp, "Production and Properties of Nickel-Phosphorus Alloy Coatings on Aluminum Structural Components", Aluminum 1978, 54 (10), 654–655.

"Electroless Nickel Plating", by William D. Fields and Ronald N. Duncan, pp. 219–243.

"Electrodeposition of Alloys, Principles and Practice", by Abner Brenner, vol. II, 1963, pp. 458–461 & 483.

"Nickel Plating", by F. Carlin, 39th Metal Finishing Guide Book Directory for 1971, pp. 312–335.

*Primary Examiner*—R. L. Andrews

*Attorney, Agent, or Firm*—Nixon & Vanderhye

[57] ABSTRACT

A plating bath for nickel and/or cobalt phosphorus amorphous alloy coating can last almost indefinitely. The anode current density of the bath is controlled so as to maintain the amount of phosphoric acid in the bath constant, and less than a level (e.g. around 0.5 molar) at which it has significant deleterious effects on the bath, i.e. maintaining the free acid concentration in the bath in an acid titer range of about 9–14. The anode current density is maintained at about 200 amperes per square foot or greater, and preferably about 500 amperes per square foot or greater, by employing an anode construction that comprises a plurality of widely spaced strips (e.g. wires) of platinum or rhodium; e.g. platinum wires each having a diameter of about 0.010 inches and, for example, a length of about 3.2 inches, and disposed vertically and generally parallel to, but spaced from, a face of a cathode-workpiece that is to be plated with nickel phosphorus, cobalt phosphorus, or nickel/cobalt phosphorus. The anode alternatively may comprise a wire extending in zig-zag fashion between a pair of spaced bus bars. The methods according to the invention are particularly useful for plating fluid jet orifice plates, electrical contacts, carbon steel or stainless steel cutlery, aluminum articles, cookware substrates (such as aluminum, stainless steel, copper, iron, or cast iron substrates), magnetic or magnetizable material such as computer memory storage discs, and wear surfaces such as thrust bearings, shafts for high speed machinery, or the like.

46 Claims, 3 Drawing Figures

Fig. 1.
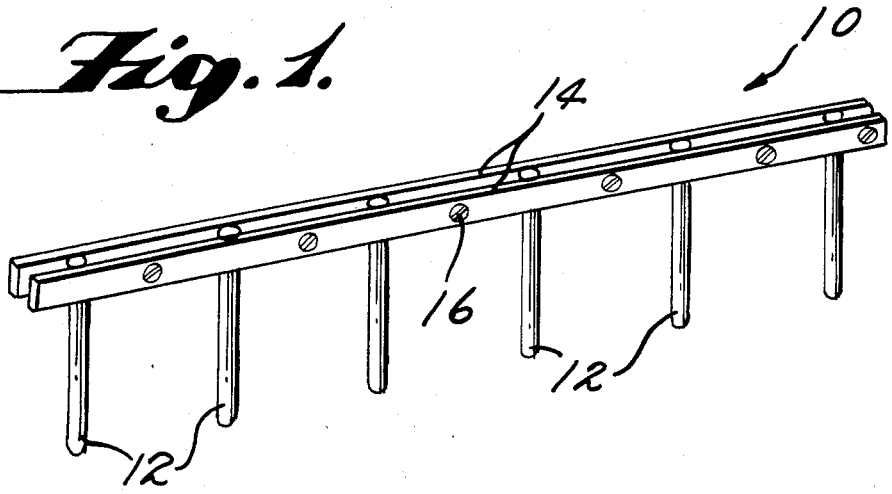
Fig. 3.
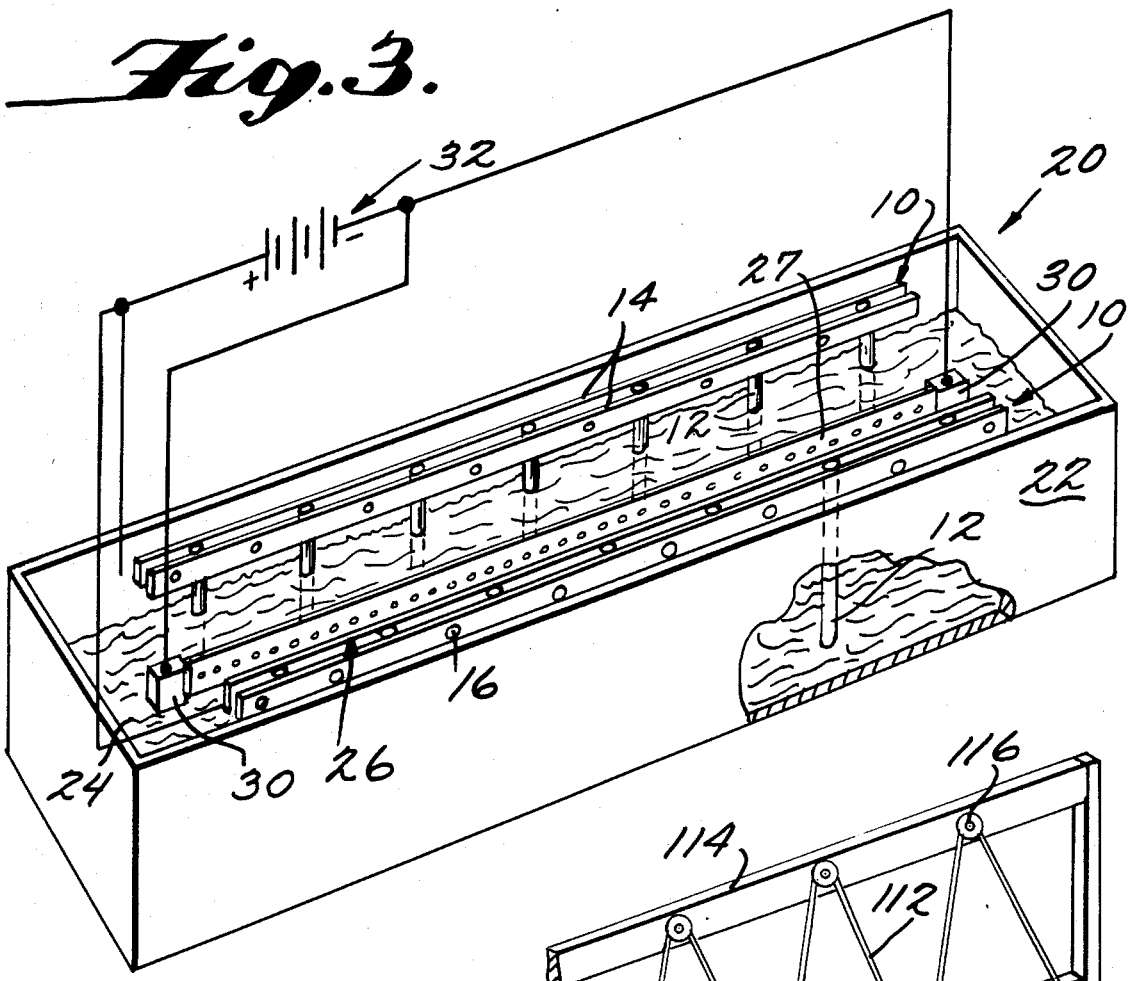
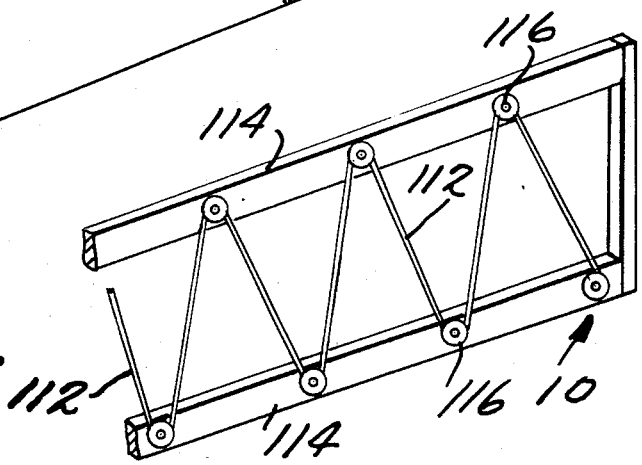
Fig. 2.

COMMERCIAL NICKEL PHOSPHORUS ELECTROPLATING

BACKGROUND AND SUMMARY OF THE INVENTION

The utilization of electrolytically deposited nickel phosphorus, cobalt phosphorus, and nickel cobalt phosphorus coatings having an amorphous structure has been found to be useful in a wide variety of circumstances. For instance as disclosed in co-pending application Ser. No. 464,101 filed Feb. 4, 1983, a method for producing a fluid jet orifice plate having enhanced utility, by electrolytically coating the substrate metal of the orifice plate with an amorphous nickel phosphorus alloy, is provided. The production of electrical contacts, and other products, utilizing such a coating procedure, also has been recognized. While the plated objects so produced have a number of distinct advantages over like but non-coated articles, to date there has not been a truly significant commercialization of a wide variety of nickel and/or cobalt phosphorus coated articles. This may be due, in part, to the relatively quick destruction of baths used in the plating processes.

According to one conventional procedure, in order to obtain an amorphous nickel and/or cobalt phosphorus coating, the major phosphorus component of the bath is provided by phosphorous acid, with the nickel provided by $NiCl_2$ and a small amount of $NiCO_3$, with $CoCl_2$ replacing the $NiCl_2$ to various degrees when a cobalt component of the alloy is also desired. Plating can be practiced without any phosphoric acid, but typically a small amount of phosphoric acid (compared to the amount of phosphorous acid) is added to the bath initially in order to facilitate the provision of relatively smooth and bright platings. Such baths are usually operated at as low an anode current density as possible, typically of about 50 amperes per square foot, or less. Upon extended plating utilizing such baths, it has been found that a number of deleterious effects occur in the bath over time. In particular, the platings obtained from the bath degrade in quality over time, in that they are less resistant to corrosion by ferric chloride or concentrated nitric acid. A typical lifetime of the bath before it need be replaced to avoid such quality degradation is about 30–50 ampere-hours per liter. During this lifetime, the cathode efficiency gradually increases from about 40% to about 70%.

According to the present invention it has been found that the major contributor of the deleterious effects on the bath has been the ever increasing concentration of free acid in the bath. A substantial proportion of this free acid is phosphoric acid ($H_3PO_4$), which is believed to result from the oxidation of phosphorous acid ($H_3PO_3$) at the anode. It has been further found according to the present invention that at low anode current densities this oxidation reaction is substantial, whereas at high anode current densities it is much less substantial, and in fact almost non-existent. Therefore, according to the present invention it has been found that it is possible to provide a bath for plating nickel and/or cobalt phosphorus in amorphous form that shows no significant deleterious effects after 250 ampere hours/liter operation where the anode current density is controlled so as to maintain the phosphoric acid concentration of the bath substantially constant, and so that it does not ever reach a value sufficient to cause deleterious effects. Preferably the phosphoric acid concentration is kept below 0.5 molar. However, it has been found that good plating can be obtained even if the phosphoric acid concentration is up to 4.6 molar, as long as the acid titer is properly controlled. The cathode efficiency of the bath according to the invention retains a value of about 40–50% throughout its life.

While the manifestation of the deleterious effects on the bath is an ever increasing concentration of phosphoric acid, it is believed that the high concentration of phosphoric acid per se is not what results in the deterioration, but rather a condition of overall excessive bath acidity. The desired free acid range in baths according to the invention is so acidic that pH meters are unreliable. Consequently, the free acid concentration is conveniently measured by acid titer. The acid titer is the volume (in milliliters) of deci-normal sodium hydroxide required, when titrating one milliliter of bath, to reach the methyl orange endpoint (which is a pH of about 4.2). The recommended acid titer range is about 9 to 14, representing 0.9 to 1.4 moles/liter of excess acid. The bath is generally maintained at approximately 10 mls. acid titer.

At acid titer below 9, the cathode efficiency decreases, undesirably, to below 30%. In the range of about 9 to 13 cathode efficiency is about 40–60%. Above acid titer 14, cathode efficiency increases to the range of 70–80%, but the corrosion resistance of the plating deteriorates, presumably due to a reduced phosphorus content in the plating. The acid titer is lowered by additions of nickel carbonate and increased by additions of phosphorous acid.

There are alternative ways of measuring the free acid level, such as by measuring the $PO_4^{-3}$, $HPO_3^{-2}$, $Cl^-$, and $Ni^{+2}$ levels and deriving the acidity. However the acid titer method has proven to be easier in practice.

Preferably, in the practice of one aspect of the method according to the invention, the anode current density is maintained so that it is always greater than about 200 amperes per square foot. At levels significantly below about 200 amperes per square foot the desired control of the phosphoric acid buildup and/or free acid concentration does not occur In fact, anode current densities of at least about 500 amperes per square foot for nickel phosphorus coating baths are preferred. Anode current densities as high as 1250 amperes per square foot are useful, and apparently the upper limits on anode current density are determined by nonelectrochemical constraints, such as $I^2R$ heating, corrosion of accessory electrical components (such as bus bars) at higher voltages, etc.

According to the present invention, the anode current density is preferably controlled utilizing a particular anode construction vis-a-vis the cathode construction. Typically, the cathode of the bath is provided by the workpiece being coated, such as a fluid jet orifice plate, cookware, cutlery, etc. The cathode-workpiece is immersed in the bath. Disposed adjacent to, but spaced from, the cathode, the anode is immersed in the bath. The precise anode configuration is not critical, as long as the anode's effective surface area is small enough that the current density is in the desired range. Those of ordinary skill in the fixturing art will readily be able to configure anodes suitable for specialized plating. According to a preferred embodiment of the invention the anode comprises a plurality of spaced strips of anode material, and a section of anode may be provided adjacent each major face of the cathode. For example, an anode may be constructed from 125 individually suspended segments of platinum wire, each having a diameter of about 0.010 inches, and each being about 3.23 inches long. It has been found that platinum and rhodium strips (e.g. wires) are more effective over time than other conventional anode materials, such as iridium, gold, palladium, rhenium, and ruthenium. Platinized titanium prevents the oxidation of phosphorous acid, but spalls and in time becomes unusable.

According to the present invention, the production of a wide variety of desirable end products having nickel and/or cobalt phosphorus coatings in amorphous form (that is, having high phosphorus contents, some up to 24 atomic percent phosphorus or more) can be produced in a commercially feasible manner.

It is the primary object of the present invention to provide an improved method and apparatus for the production of nickel and/or cobalt phosphorus electrolytically plated articles utilizing a bath having long life. This and other objects of the invention will become clear from an inspection of the detailed description of the invention, and from the appended claims.

BRIEF DESCRIPTION OF THE DRAWINGS

FIG. 1 is a schematic perspective view of a portion of a section of an exemplary anode utilizable in the practice of the present invention;

FIG. 2 is a schematic perspective view of a portion of another exemplary anode construction according to the present invention; and FIG. 3 is a schematic perspective view of an exemplary bath in which plating of a fluid jet orifice plate is being practiced, in accordance with the present invention, using anodes like the anode in FIG. 1.

DETAILED DESCRIPTION OF THE INVENTION

According to the method of the present invention, it has been found that if the anode current density is maintained at a high enough level, the oxidation of phosphorous acid to phosphoric acid within the plating bath is controlled such that there is essentially no increase in the level of phosphoric acid within the bath, so that deleterious effects that result from an increasing concentration of $H_3PO_4$ are avoided, and/or the free acid concentration is controllable so that it is in an acid titer range of about 9–14. The bath can have an indefinite life as long as phosphorous acid and sources of nickel and/or cobalt are added. These sources initially are preferably in the form of $NiCl_2$ and/or $CoCl_2$, to promote conductivity, together with lesser amounts of $NiCO_3$ and/or $CoCO_3$. Makeup sources during plating preferably are $NiCO_3$ and/or $CoCO_3$, to avoid chloride buildup in the bath, while evolving $CO_2$. Preferably according to the method of the present invention the anode current density is maintained at a minimum level of about 200 amperes per square foot, with a preferred anode current density, particularly for nickel phosphorus plating, of a minimum of about 500 amperes per square foot. The desired high anode current density may be achieved according to the present invention by utilizing an anode of small effective area.

One desirable particular anode configuration according to the present invention is illustrated schematically, generally, by the reference numeral 10 in FIG. 1. The anode 10 consists of a large plurality of widely spaced, essentially parallel, strips (e.g. wires, or rectangular cross-section segments) 12 of anodic material. The strips are held in their widely spaced positions, as illustrated in FIG. 1, preferably by a pair of titanium bars 14, with one end of each of the strips 12 being sandwiched between the bars 14, and with screws 16, or like fasteners, clamping the strips between the bars 14, with a screw 16 disposed between each pair of strips 12. For best operation, the anodic material comprising the strips 12 is selected from the group consisting essentially of platinum and rhodium. Iridium, gold, palladium, rhenium, ruthenium, and other like conventional anodic materials, are much less desirable.

The length, cross-sectional area, number, spacing, and like variables of the anode strips 12 may vary widely, so long as the general requirements of maintaining an anode current density of at least about 200 amperes per square foot (and preferably at least about 500 amperes per square foot) are met. In one example an anode 10 would comprise 125 strips 12 of platinum wire having a diameter of 0.010 inches, and each strip having a length of 3.23 inches.

Another exemplary anode configuration is illustrated at 110 in FIG. 2, and comprises a piece of platinum or rhodium wire 112 which zig-zags back and forth between titanium screws 116 associated with a pair of titanium bus bars 114, to provide widely spaced portions.

Anode configuration will vary depending upon the shape of the piece being plated, with the object being to have the anode equidistant to all parts of the piece being plated, to insure uniform plating.

A typical bath according to the present invention is illustrated schematically and generally by reference numeral 20 in FIG. 3. The bath 20 includes a container 22 of conventional construction and material, having the bath liquid 24 disposed therein. The bath liquid initially includes $NiCl_2$ and/or $CoCl_2$, a small amount of $NiCO_3$, a relatively large amount of phosphorous acid, and a relatively small amount of phosphoric acid. Of course other bath constituents can be utilized depending on the particular workpieces being plated, and other conditions. Bath additives that might affect electrical resistance of the workpieces being plated, or corrosion protection, include boric acid, acetic acid, surfactants of the alkoxylated linear alcoholic class, succinic acid, and the like. Typical constituents of an initial plating bath would be 1.25 molar $H_3PO_3$, 0.30 molar $H_3PO_4$, 0.25 molar $NiCO_3$, with $NiCl_2$ and $CoCl_2$ together comprising about 0.75 molar. Where no cobalt is provided in the final alloy, but the final alloy being coated is solely nickel phosphorus, as much as about 0.90 molar $NiCl_2$ may be desirable.

In initially making up the bath, the nickel chloride, phosphorous acid, and phosphoric acid are added to the bath as liquids and nickel carbonate is added to adjust acid titer. As noted above, makeup of nickel ions as plating proceeds is preferably effected by addition of $NiCO_3$ at intervals.

The bath 20 further comprises, immersed therein, one or more anode sections 10. As illustrated schematically in FIG. 3, the anode sections 10 are disposed with respect to the bath container 22 so that most of the length of the strips 12 thereof is immersed in the bath, while the titanium buses 14 remain above the level of the bath. For the bath 20 illustrated in FIG. 3, the cathode-workpiece is in the form of a fluid jet orifice plate 26 which has a pair of opposite major side faces thereof, one of the side faces 27 being seen in FIG. 3, which major side faces have significantly more area than the other portions of the plate 26. The plate 26 is typically clamped by clamps 30 at the ends thereof so that it is immersed within the bath, and an anode section 10 is disposed on either side of the plate 26 so that each of the anode sections 10 is parallel to and adjacent (but spaced from) one of the faces (e.g. face 27). A typical spacing between the anode 10 adjacent the face 27 and the other face 27 is 8.5 inches, although the spacing may be varied widely depending upon the type of cathode-workpiece 26, and other conditions.

The apparatus 20 according to the invention includes as the final major component a battery 32, or like source of electrical power, which is operatively electrically connected to the anode sections 10, and to the cathode-workpiece 26.

In the practice of the present invention, the cathode current density will widely vary depending upon the particular geometry of the cathode-workpiece, and other variables. A typical cathode current density would be about 50 amperes per square foot, regardless of the cathode area. Typical variations in cathode area, and like parameters, in exemplary manners of practice of the invention are indicated by the following table I:

TABLE I

| CATHODE AREA PER SIDE | AMPERES/ ANODE | ANODE WIRE DIAM-ETER | ANODE CUR-RENT DENSITY | VOLT-AGE |
|---|---|---|---|---|
| .5 sq. ft. | 25 | .01" | 280 ASF | |
| 1 sq. ft. | 50 | .01" | 570 ASF | 5.6–5.9 volts |
| 1.76 sq. ft. | 88 | .008" | 1250 ASF | |
| 1.76 sq. ft. | 88 | .01" | 1000 ASF | 7.9–8.0 volts |

Typical examples of the practice of exemplary methods according to the present invention are as follows:

EXAMPLE 1

An initial bath formulation comprising 1.25 molar $H_3PO_3$0.30 molar $H_3PO_4$0.90 molar $NiCl_2$, and 0.25 molar $NiCO_3$, was provided. Two anodes 10 having platinum strips (portions) 12, as illustrated in FIGS. 1 and 3, were provided, and the cathode-workpiece 26 being plated was a 1.8 meter long plate. A number of plates 26 were consecutively plated, with sufficient $NiCO_3$ and phosphorous acid being added at intervals to replenish the nickel and phosphorus components of the bath. $H_3PO_4$ concentration readings were taken at various points of time, and were 0.31, 0.31, 0.28, and 0.30 molar respectively. Nickel phosphorus coatings produced were amorphous, with a high concentration (viz. about 20+ atomic percent) of phosphorus. The anode current density was about 1,000 amperes per square foot, with an anode amperage of 88 amperes.

EXAMPLE 2

After the practice of Example 1, utilizing the same bath, after the fourth phosphoric acid reading, one of the platinum wire anodes 10 was replaced by a 4 inch×80 inch platinized titanium anode, having an effective area of about 2.2 square feet and at the same anode amperage of 88 amperes, thus having an anode current density of about 40 amperes per square foot. The voltage required to pass that amperage was 6–6.1 volts with the cell geometry being the same as with the anode it replaced (anodes parallel with and about 8.5 inches from the cathode-workpiece). The phosphoric acid concentration was measured shortly after substitution of the platinized titanium anode for the platinum wire anode, and was found to be 0.35 molar. After that measurement, the original platinum wire anode was put back into the system, another week of plating (at about 1,000 and after amperes per square foot) the phosphoric acid concentration was measured and found to be 0.36 molar, that is, essentially unchanged.

EXAMPLE 3

Utilizing the bath of Example 1, and after continuous plating of fluid jet orifice plates therewith with periodic replenishment with $NiCO_3$ and phosphorous acid, after 250 ampere hours per liter the bath showed no sign of failure (as would have been evidenced by reduced resistance of the plating to corrosive attack by ferric chloride or concentrated $HNO_3$); in addition, the bath continued throughout its life to operate at about 40–50 percent cathode efficiency.

EXAMPLE 4

A bath was made up which included $CoCl_2$ in addition to the $NiCl_2$, with the $CoCl_2$ and $NiCl_2$ combined making up 0.75 molar. The other constituents of the bath were the same as set forth in Example 1. Anode current density was maintained in the range of 250–500 amperes per square foot, with the anode current density not being increased significantly above 500 amperes per square foot to ensure that oxidation of $Co^{+2}$ to $Co^{+3}$ did not occur. Good quality nickel cobalt phosphorus coatings were produced.

EXAMPLE 5

A bath was made up containing 0.75 molar $NiCl_2$, 0.25 molar $CoCO_3$, 1.2 molar phosphorous acid, and 0.2 molar phosphoric acid. The bath was held at a temperature of about 80° C. The cathode-workpiece 26 was a carbon steel knife which was cleaned by brief immersion in an alkaline cleaning solution and scrubbed and reimmersed in the alkaline cleaning solution, and then dipped in a 10% sulfuric acid solution. The knife was then immersed in the bath. The plating formed on each side of the knife edge was approximately 1/1000th of an inch thick, with the nickel cobalt phosphorus amorphous alloy actually forming the cutting edge. The knife was useful for its intended purpose, and was extremely corrosion resistant due to the nickel cobalt phosphorus alloy coating.

EXAMPLE 6

Example 5 was repeated except that a stainless steel substrate, of the same type as used for a normal scalpel knife used in surgery, was coated. The stainless steel substrate was cleaned and briefly placed in a 10% solution of sodium dichromate at room temperature and held there for approximately 2 minutes. The substrate was then immersed in the plating bath and plating continued until an electroform in approximately the shape of a scalpel knife and 10 mils thick was formed. Subsequent to plating, the scalpel-shaped coating was stripped off the stainless steel substrate and the scalpel-shaped coating subjected on its normal edge to grinding so as to form a highly sharpened edge. This edge was at least as sharp as an ordinary scalpel edge and further retained its sharpness for an inordinate time (compared to an ordinary scalpel such as can be purchased widely in the United States) when used for such testing functions as cutting wood.

EXAMPLE 7

Examples 5 and 6 were repeated except that the knife and scalpel so formed were subjected to a heat treatment of 370° C. in an inert atmosphere for a period of approximately one half hour. The resulting crystalline material was found to have extraordinary hardness and formed again an excellent corrosion resistant knife edge over the carbon steel knife. The scalpel edge was also satisfactory, however it tended to be somewhat brittle when subjected to shock loadings.

EXAMPLE 8

An aluminum substrate was thoroughly cleansed of all organic material and any residual smut or dirt. Harsh acids or alkalis were not used when cleaning the aluminum surface, but rather trichloroethylene and a mildly alkaline cleaning solution were utilized, with a rinse in a weak acid solution. The aluminum was placed at room temperature in a 3% by volume solution of 85% phosphoric acid and water while being attached to the positive terminal of an electrical power supply set to 10 volts. After the amount of current flowing gradually fell off, the aluminum was removed and found to have a phosphate coating. The aluminum was then rinsed with deionized water and the part was then placed as a cathode in a nickel phosphorus bath consisting of 0.75 molar nickelous chloride, 0.25 molar nickel carbonate, 1.2 molar phosphorous acid, and 0.2 molar phosphoric acid. The bath was held at a temperature of about 78° C. The aluminum part became coated smoothly and regularly with a coating of amorphous nickel phosphorus, and which tightly adhered so that upon 180° bending subsequent to coating the amorphous coating only showed minor cracking. The part was suitable for uses to which aluminum is commonly put (such as electrical conductors or structural members), but had a nickel phosphorus corrosion- and wear-resistant coating.

EXAMPLE 9

This example is the same as example 8 except that the substrate is formed in the shape of cookware prior to plating. The plated product produced is suitable for use as cookware.

EXAMPLE 10

This example is the same example 8 except that the 0.25 molar nickel carbonate was replaced by 0.25 molar cobalt carbonate and the resulting plating consisted of approximately 40 atomic percent cobalt, 40 atomic nickel, and 20 atomic percent phosphorus. The material electroplated was again bright, shiny, smooth, and tightly adhering to the aluminum substrate, and the coated aluminum was suitable for use as cookware or for other purposes for which aluminum is commonly employed.

EXAMPLE 11

Example 9 was repeated except that a small amount (1–5%) of fluorinated polymer (polytetrafluoroethylene) was provided in the coating bath, and coating was practiced so that the coating had a final thickness of about 1 mil. The coating had an extremely hard chemically stable surface with a relatively high degree of lubricity, which lubricity was maintained even when the surface was scrubbed with abrasive materials. When subjected to leach tests, no dissolution of the metallic coating under ordinary circumstances was found. The product produced was suitable for use as cookware and other ordinary kitchen utensils. This same technique was applicable to overcoating cast iron, iron, stainless steel, and copper substrates instead of aluminum substrates, and these also were suitable for use as cookware or other ordinary kitchen utensils.

Other specific methods that may be practiced according to the invention relate to the production of:

Jewelry, and other articles of personal apparel; the nickel and/or cobalt phosphorus coating is noble with respect to most common corrodants, including salt and other materials commonly found in perspiration, and no appreciable amounts of nickel or cobalt ions are given off. Such items may be worn in close contact to human skin (as opposed to nickel to which approximately 10% of the population develop an allergic reaction). The electrocoatings may be used to overcoat base metal or base metal overcoated with copper, and the electrocoatings can also be overcoated with chromium or gold with the brightness properties preserved in the final product.

Wear surfaces, wherein there is relative movement between machine elements or components such as between a cylinder wall and piston rings, or the heddle bar in fabric weaving with the passage of fabric components over its surface, or pump parts, or thrust bearings, or shafts for high speed machinery; parts can be produced in the as-plated condition with nickel phosphorus coatings having a Knoop value of approximately 455–500, and cobalt phosphorus coatings with an initial Knoop value of 750; after heat treating plated parts at approximately 400° C. for one hour the hardness of the nickel phosphorus coating is raised to approximately 800, while the hardness of the cobalt phosphorus is 800, while raised to about 1275; the surfaces tend to show a high degree of lubricity in application and have improved wear properties compared to hard chrome or other common coatings used as wear surfaces.

Electrical contacts can be produced, such as described in co-pending application Ser. No. 609,137 filed May 11, 1984, with or without gold overcoatings; the electrical contacts have a contact resistance soon after production of less than 4 milliohms.

Plastic substrates may be coated by preparing the surfaces thereof with zinc chloride, chromic acid, or the like, and then sensitizing the surfaces with palladium chloride or the like. The surfaces of the substrates are then struck with electroless nickel, electroless copper or the like to provide a conductive layer on the surfaces. The treated substrates are then immersed in a plating bath, and act as the cathode.

Other uses include: Marine hardware (and other components exposed to corrosive salt environments), wherein a metal substrate is formed in the shape of a piece of marine hardware prior to immersion in the bath. Electromagnets, magnetic metalized tapes, high-speed scanning members, computer memory storage discs, and other magnetic, or magnetizable, material objects. Screw threads, valves, pump impellers, storage tanks, and the like.

As regards computer memory storage disks, in one embodiment, an aluminum substrate may be treated as described in Example 8 and plated with a first layer of nickel-phosphorus. A second layer including a proportion of cobalt in the amorphous deposition is then applied over the first layer. The second layer serves as the magnetic memory and the first layer provides electrical isolation from the aluminum substrate. Resurrection of a deteriorated bath also is possible employing the principles according to the present invention. Since too high a free acid concentration is a cause of the bath deterioration, resurrection of the bath is possible by the addition of basic material to return the bath to a suitable free acid concentration (that is an acid titer range of about 9–14). This is preferably accomplished by adding basic material in the form of nickel carbonate or nickel hydroxide to the bath.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods, procedures, and structures.

What is claimed is:

1. A method of electrolytically plating a nickel and/or cobalt phosphorus alloy on a substrate, utilizing a bath which includes a major amount of phosphorous acid and a minor amount of phosphoric acid, comprising the steps of:

(a) immersing a substrate as a cathode in the bath;

(b) immersing an anode in the bath; and (c) applying an electrical potential across the anode and cathode so as to effect electrodeposition of a nickel and/or cobalt phosphorus alloy on the substrate, while retaining the anode current density high enough so as to essentially prevent the buildup of phosphoric acid in the bath and thereby significantly increase bath life.

2. A method as recited in claim 1 wherein step (c) is practiced by maintaining the anode current density at a minimum of about 200 amperes per square foot.

3. A method as recited in claim 2 wherein the anode is of a material selected from the group consisting of platinum and rhodium.

4. A method as recited in claim 3 wherein step (c) is practiced so as to maintain the anode current density at a minimum of about 500 amperes per square foot.

5. A method as recited in claim 3 wherein step (b) is practiced by providing the anode as a plurality of thin, widely spaced, strips of material mechanically and electrically connected together at top portions thereof above the bath, and by providing a section of a plurality of widely spaced strips on opposite sides of the cathode.

6. A method as recited in claim 1 wherein the initial constituents of the bath comprise about 1.25 molar $H_3PO_3$, about 0.30 molar $H_3PO_4$, about 0.75 molar $CoCl_2$ and/or $NiCl_2$, and about 0.25 molar $NiCO_3$; and wherein step (c) is practiced so that the concentration of $H_3PO_4$ never rises above about 0.50 molar.

7. A method of electrolytically plating a nickel and/or cobalt phosphorus alloy on a substrate, utilizing a bath which includes phosphorous and/or phosphoric acid, comprising the steps of:

(a) immersing a substrate as a cathode in the bath;

(b) immersing an anode in the bath; and (c) applying an electrical potential across the anode and cathode so as to effect electrodeposition of a nickel and/or cobalt phosphorus alloy on the substrate, while retaining the anode current density high enough so as to maintain the free acid concentration in the bath in an acid titer range of about 9–14.

8. A method as recited in claim 7 wherein step (c) is practiced by maintaining the anode current density at a minimum of about 200 amperes per square foot.

9. A method as recited in claim 8 wherein the anode is of a material selected from the group consisting of platinum and rhodium.

10. A method as recited in claim 9 wherein step (c) is practiced so as to maintain the anode current density at a minimum of about 500 amperes per square foot.

11. A method as recited in claim 9 wherein step (b) is practiced by providing the anode as a plurality of thin, widely spaced, strips of material mechanically and electrically connected together at top portions thereof above the bath, and by providing a section of a plurality of widely spaced strips on opposite sides of the cathode.

12. A method of forming an electrical contact, comprising the steps of:

(a) immersing an electrically conductive substrate in an electrolytic bath including nickel and/or cobalt, and phosphorous acid, with the substrate acting as the cathode in the bath;

(b) providing an anode immersed in the bath; and (c) applying an electrical power across the anode and the cathode sufficient to effect electrolytic deposition of a nickel and/or cobalt phosphorus alloy, in amorphous form, on the cathode, and so that the bath has sufficient life to provide commercially feasible plating of the electrical contact, to produce an electrical contact having a contact resistance soon after production of less than 4 milliohms, and which is adapted to make or break contact with another electrical contact to complete or interrupt an electrical circuit.

13. A method as recited in claim 12 wherein the bath includes an initial relatively small amount of phosphoric acid (compared to the amount of phosphorous acid), and wherein step (c) is practiced by repeatedly replenishing the amount of phosphorous acid in the bath, and by controlling the current density so as to substantially maintain the concentration of phosphoric acid and/or free acid in the bath below a level wherein it has significant deleterious effects on the bath which would make the bath longer commercially useless.

14. A method as recited in claim 13 wherein step (c) is practiced by maintaining the anode current density at a minimum of about 200 amperes per square foot, and wherein the anode is of a material selected from the group consisting of platinum and rhodium.

15. A method of forming a piece of cutlery having a cutting edge, comprising the steps of:

(a) immersing the cutlery piece in an electrolytic bath including nickel and/or cobalt, and phosphorous acid, with the cutlery piece acting as the cathode in the bath;

(b) providing an anode immersed in the bath; and (c) applying an electrical power across the anode and the cathode sufficient to effect electrolytic deposition of a nickel and/or cobalt phosphorus alloy, in amorphous form, on the cathode, and so that the bath has sufficient life to provide commercially feasible plating of the cutlery piece.

16. A method as recited in claim 15 wherein the bath includes an initial relatively small amount of phosphoric acid (compared to the amount of phosphorous acid), and wherein step (c) is practiced by repeatedly replenishing the amount of phosphorous acid in the bath, and by controlling the current density so as to substantially maintain the concentration of phosphoric acid and/or free acid in the bath below a level wherein it has significant deleterious effects on the bath which would make the bath longer commercially useless.

17. A method as recited in claim 16 wherein step (c) is practiced by maintaining the anode current density at a minimum of about 200 amperes per square foot.

18. A method as recited in claim 17 wherein the anode is of a material selected from the group consisting of platinum and rhodium.

19. A method of forming a coated aluminum article having enhanced properties and suitable for use in place of a like non-coated aluminum article, comprising the steps of:

(a) immersing the aluminum article in an electrolytic bath including nickel and/or cobalt, and phosphorous acid, with the aluminum article acting as the cathode in the bath;

(b) providing an anode immersed in the bath; and (c) applying an electrical power across the anode and the cathode sufficient to effect electrolytic deposition of a nickel and/or cobalt phosphorus alloy, in amorphous form, on the cathode, and so that the bath has sufficient life to provide commercially feasible plating of the aluminum article.

20. A method as recited in claim 19 comprising the further steps, prior to step (a), of cleaning and phosphatizing the aluminum article.

21. A method as recited in claim 20 wherein the bath includes an initial relatively small amount of phosphoric acid (compared to the amount of phosphorous acid), and wherein step (c) is practiced by repeatedly replenishing the amount of phosphorous acid in the bath, and by controlling the current density so as to substantially maintain the concentration of phosphoric acid and/or free acid in the bath below a level wherein it has significant deleterious effects on the bath which would make the bath longer commercially useless.

22. A method as recited in claim 21 wherein step (c) is practiced by maintaining the anode current density at a minimum of about 200 amperes per square foot.

23. A method as recited in claim 22 wherein the anode is of a material selected from the group consisting of platinum and rhodium.

24. A method of making an item of cookware, comprising the steps of:

(a) immersing a substrate formed in the shape of an item of cookware and of a material selected from the group consisting of aluminum, stainless steel, copper, iron, and cast iron, in an electrolytic bath including nickel and/or cobalt, and phosphorous acid, with the substrate acting as the cathode in the bath;

(b) providing an anode immersed in the bath; and (c) applying an electrical potential across the anode and the cathode sufficient to effect electrolytic deposition of a nickel and/or cobalt phosphorus alloy, in amorphous form, on the cathode, and so that the bath has sufficient life to provide commercially feasible plating of an item of cookware.

25. A method as recited in claim 24 wherein the bath includes an initial relatively small amount of phosphoric acid (compared to the amount of phosphorous acid), and wherein step (c) is practiced by repeatedly replenishing the amount of phosphorous acid in the bath, and by controlling the current density so as to substantially maintain the concentration of phosphoric acid and/or free acid in the bath below a level wherein it has significant deleterious effects on the bath which would make the bath longer commercially useless.

26. A method as recited in claim 25 wherein step (c) is practiced by maintaining the anode current density at a minimum of about 200 amperes per square foot.

27. A method as recited in claim 26 wherein the anode is of a material selected from the group consisting of platinum and rhodium.

28. A method of forming a piece of marine hardware, comprising the steps of:

(a) immersing a metal substrate having the shape of a piece of marine hardware in an electrolytic bath including nickel and/or cobalt, and phosphorous acid, with the substrate acting as the cathode in the bath;

(b) providing an anode immersed in the bath; and (c) applying an electrical power across the anode and the cathode sufficient to effect electrolytic deposition of a nickel and/or cobalt phosphorus alloy, in amorphous form, on the substrate, and so that the bath has sufficient life to provide commercially feasible plating of the material.

29. A method as recited in claim 28 wherein the bath includes an initial relatively small amount of phosphoric acid (compared to the amount of phosphorous acid), and wherein step (c) is practiced by repeatedly replenishing the amount of phosphorous acid in the bath, and by controlling the current density so as to substantially maintain the concentration of phosphoric acid and/or free acid in the bath below a level wherein it has significant deleterious effects on the bath which would make the bath longer commercially useless.

30. A method as recited in claim 29 wherein step (c) is practiced by maintaining the anode current density at a minimum of about 200 amperes per square foot.

31. A method as recited in claim 30 wherein the anode is of a material selected from the group consisting of platinum and rhodium.

32. A method of forming coated plastic objects, comprising the steps of:

(a) treating a plastic substrate so that it has sensitized surfaces;

(a1) striking the sensitized surfaces with an electroless metal to provide a conductive layer on the surfaces;

(b) immersing the sensitized plastic substrate in an electrolytic bath including nickel and/or cobalt, and phosphorous acid, with the substrate acting as the cathode in the bath;

(c) providing an anode immersed in the bath; and (d) applying an electrical power across the anode and the cathode sufficient to effect electrolytic deposition of a nickel and/or cobalt phosphorus alloy, in amorphous form, on the substrate, so that the bath has sufficient life to provide commercially feasible plating of the material.

33. A method as recited in claim 32 wherein step (a) is practiced by first treating the substrate with zinc chloride or chromic acid, and then with palladium chloride.

34. A method as recited in claim 32 wherein the bath includes an initial relatively small amount of phosphoric acid (compared to the amount of phosphorous acid), and wherein step (c) is practiced by repeatedly replenishing the amount of phosphorous acid in the bath, and by controlling the current density so as to substantially maintain the concentration of phosphoric acid and/or free acid in the bath below a level wherein it has significant deleterious effects on the bath which would make the bath longer commercially useless.

35. A method as recited in claim 34 wherein step (d) is practiced by maintaining the anode current density at a minimum of about 200 amperes per square foot.

36. A method as recited in claim 35 wherein the anode is of a material selected from the group consisting of platinum and rhodium.

37. A method of forming a fluid jet orifice plate, comprising the steps of:

(a) immersing the orifice plate in an electrolytic bath including nickel and/or cobalt, and phosphorous acid, with the orifice plate acting as the cathode in the bath;

(b) providing an anode immersed in the bath; and (c) applying an electrical potential across the anode and the cathode sufficient to effect electrolytic deposition of a nickel and/or cobalt phosphorus alloy, in amorphous form, on the cathode, and so that the bath has sufficient life to provide commercially feasible plating of the orifice plate.

38. A method as recited in claim 37 wherein the bath includes an initial relatively small amount of phosphoric acid (compared to the amount of phosphorous acid), and wherein step (c) is practiced by repeatedly replenishing the amount of phosphorous acid in the bath, and by controlling the current density so as to substantially maintain the concentration of phosphoric acid and/or free acid in the bath below a level wherein it has significant deleterious effects on the bath which would make the bath longer commercially useless.

39. A method as recited in claim 38 wherein step (c) is practiced by maintaining the anode current density at a minimum of about 200 amperes per square foot.

40. A method as recited in claim 39 wherein the anode is of a material selected from the group consisting of platinum and rhodium.

41. A method as recited in claim 38 wherein the bath contains nickel, and wherein the nickel is periodically replenished by adding $NiCO_3$ to the bath.

42. A method of resurrecting a bath for electrolytically plating nickel and/or cobalt phosphorus alloy on a substrate, which bath includes nickel and/or cobalt and phosphorous and/or phosphoric acid, comprising the step of maintaining the bath by adding basic material to bath until the free acid concentration of the bath has an acid titer range of about 9–14, and has sufficient nickel and/or cobalt, and phosphorus, therein to effect electrodeposition of a nickel and/or cobalt phosphorus alloy on a substrate.

43. A method as recited in claim 42 wherein said basic material adding step is practiced by adding material selected from the group consisting of nickel carbonate and nickel hydroxide.

44. A method of forming jewelry, comprising the steps of:

(a) immersing a substrate formed in the shape of a piece of jewelry in an electrolytic bath including nickel and/or cobalt, and phosphorous acid, with the substrate acting as the cathode in the bath;

(b) providing an anode immersed in the bath; and (c) applying an electrical potential across the anode and the cathode sufficient to effect electrolytic deposition of a nickel and/or cobalt phosphorus alloy, in amorphous form, on the cathode, and so that the bath has sufficient life to provide commercially feasible plating of an item of jewelry.

45. A method of forming a computer memory disc, comprising the steps of:

(a) immersing a substrate formed in the shape of a piece of computer memory disc in an electrolytic bath including nickel and/or cobalt, and phosphorous acid, with the substrate acting as the cathode in the bath;

(b) providing an anode immersed in the bath; and (c) applying an electrical potential across the anode and the cathode sufficient to effect electrolytic deposition of a nickel and/or cobalt phosphorus alloy, in amorphous form, on the cathode, and so that the bath has sufficient life to provide commercially feasible plating of a computer memory disc.

46. A method of forming a wearable part, comprising the steps of:

(a) immersing a substrate formed in the shape of a wearable part in an electrolytic bath including nickel and/or cobalt, and phosphorous acid, with the substrate acting as the cathode in the bath;

(b) providing an anode immersed in the bath; and (c) applying an electrical potential across the anode and the cathode sufficient to effect electrolytic deposition of a nickel and/or cobalt phosphorus alloy, in amorphous form, on the cathode, and so that the bath has sufficient life to provide commercially feasible plating of a wearable part.

* * * * *

UNITED STATES PATENT AND TRADEMARK OFFICE

CERTIFICATE OF CORRECTION

PATENT NO. : 4,673,468

DATED : June 16, 1987

INVENTOR(S) : Myers et al.

It is certified that error appears in the above-identified patent and that said Letters Patent is hereby corrected as shown below:

Col. 5, line 40, insert a space before "0.30" and before "0.90"

Col. 6, line 4, before "another" insert --and after--;
line 5, delete "and after"

Col. 7, line 47, insert --as-- after "same"

Col. 8, line 34, delete "800,"
line 35, delete "while"
line 68, "Resurrection" begins a new paragraph Col. 10, line 43, delete "longer"

Col. 11, line 3, delete "longer"
line 37, delete "longer"

Col. 12, line 2, delete "longer"
line 32, delete "longer"

Col. 13, line 2, delete "longer"
line 31, delete "longer"

Signed and Sealed this

Twenty-fourth Day of November, 1987

*Attest:*

DONALD J. QUIGG

*Attesting Officer*

*Commissioner of Patents and Trademarks*